US008033270B2

(12) United States Patent
Yamagishi et al.

(10) Patent No.: US 8,033,270 B2
(45) Date of Patent: Oct. 11, 2011

(54) FUEL DISTRIBUTION APPARATUS FOR A V-TYPE ENGINE

(75) Inventors: Naoto Yamagishi, Wako (JP); Takashi Yokoyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 338 days.

(21) Appl. No.: 12/392,402

(22) Filed: Feb. 25, 2009

(65) Prior Publication Data

US 2009/0241923 A1 Oct. 1, 2009

(30) Foreign Application Priority Data

Mar. 28, 2008 (JP) ..... 2008-086858

(51) Int. Cl.
*F02M 55/02* (2006.01)
*F02M 55/00* (2006.01)

(52) U.S. Cl. ..... 123/469; 123/470

(58) Field of Classification Search ..... 123/379, 123/456, 447, 468, 469, 470, 54.4, 184.31; 138/26, 30
See application file for complete search history.

(56) References Cited

U.S. PATENT DOCUMENTS

| | | | | |
|---|---|---|---|---|
| 7,152,577 | B2 * | 12/2006 | Nakagawa | 123/336 |
| 2006/0162697 | A1 * | 7/2006 | Stieler et al. | 123/456 |
| 2008/0029062 | A1 * | 2/2008 | Toriumi et al. | 123/337 |

FOREIGN PATENT DOCUMENTS

JP 2006-233806 A 9/2006

* cited by examiner

*Primary Examiner* — Mahmoud Gimie
(74) *Attorney, Agent, or Firm* — Westerman, Hattori, Daniels & Adrian, LLP

(57) ABSTRACT

A fuel distribution apparatus for a V-type engine wherein first and second throttle bodies connected to first and second banks disposed in a V shape, respectively, are disposed therebetween and a main fuel distribution pipe for distributing fuel from a common fuel supply system is connected to first and second fuel injection valves provided in the first and second throttle bodies, respectively, is configured such that the fuel distribution pipe is formed from first and second distribution pipes separate from each other and connected to the first and second fuel injection valves and besides fastened to the first and second throttle bodies, respectively, a joint pipe connects the fuel supply to the first or second distribution pipes. Communication conduit connects the first and second distribution pipes.

3 Claims, 7 Drawing Sheets

FUEL DISTRIBUTION APPARATUS FOR A V-TYPE ENGINE

BACKGROUND OF THE INVENTION

This invention relates to improvements in a fuel distribution apparatus for a V-type engine wherein first and second throttle bodies connected to first and second banks disposed in a V shape, respectively, are disposed between the first and second banks and a fuel distribution pipe for distributing fuel from a common fuel supply system is connected to first and second fuel injection valves provided in the first and second throttle bodies, respectively.

As such a fuel distribution apparatus for a V-type engine as just described, a fuel injection apparatus wherein the fuel distribution pipe is composed of a straight pipe held by a pair of fixing brackets and connecting to a fuel supply system and a plurality of distribution pipes fitted in a skewered fashion in the straight pipe and connected to fuel injection valves of individual banks for distributing fuel from the straight pipe to the fuel injection valves is already known as disclosed in Japanese Patent Laid-Open No. 2006-233806

SUMMARY OF THE INVENTION

In the conventional apparatus described above, since the plural distribution pipes are fitted in a skewered fashion in the straight pipe held by the pair of fixing brackets, if the accuracy in position between the plural throttle bodies is not raised, it is difficult to precisely connect the distribution pipes to the corresponding fuel injection valves.

The present invention has been made in view of such a situation as described above, and it is an object of the present invention to provide a fuel distribution apparatus for a V-type engine which can absorb, even if first and second throttle bodies have some positional displacement therebetween, the positional displacement to precisely carry out connection of fuel distribution pipes to first and second fuel injection valves.

In order to attain the object described above, according to the present invention, a fuel distribution apparatus for a V-type engine wherein first and second throttle bodies connected to first and second banks disposed in a V shape, respectively, are disposed between the first and second banks and a fuel distribution pipe for distributing fuel from a common fuel supply system is connected to first and second fuel injection valves provided in the first and second throttle bodies, respectively, has a first characteristic in that the fuel distribution pipe is formed from a first distribution pipe integrally including a first connection portion connecting to the first fuel injection valve and a first fastening portion fastened to the first throttle body, a second distribution pipe separate from the first distribution pipe and integrally including a second connection portion connecting to the second fuel injection valve and a second fastening portion fastened to the second throttle body, a joint pipe formed for one of the first and second distribution pipes for connecting the fuel supply system, and communication means for communicating the first and second distribution pipes with each other and absorbing a positional displacement between the first and second distribution pipes.

It is to be noted that the first and second connection portions described above correspond to first and second connection caps 241 and 242, respectively, in working examples of the present invention hereinafter described, and the first and second fastening portions correspond to first and second fastening bosses 261 and 262, respectively.

Further, according to the present invention, the fuel distribution apparatus for a V-type engine has, in addition to the first characteristic, a second characteristic in that the communication means is formed from a communication pipe fitted at both free end portions thereof in the first and second distribution pipes and seal members interposed in the fitting portions, and the positional displacement between the first and second distribution pipes is absorbed by elastic deformation of the seal members.

Furthermore, according to the present invention, a fuel distribution apparatus for a V-type engine wherein first and second throttle bodies connected to first and second banks disposed in a V shape, respectively, are disposed between the first and second banks and a fuel distribution pipe for distributing fuel from a common fuel supply system is connected to first and second fuel injection valves provided in the first and second throttle bodies, respectively, has a third characteristic in that the first and second fuel injection valves are disposed in such a manner as to exhibit an inverted V shape as viewed in side elevation, and first and second connection caps fitted in fuel entrance tube portions of the first and second fuel injection valves, a communication pipe for communicating the first and second connection caps with each other, a joint pipe for connecting the fuel supply system and a fastening portion for being fastened to only one of the first and second throttle bodies are formed integrally to form the fuel distribution pipe.

In a characteristic of the present invention, if some positional displacement occurs also between the first and second distribution pipes by positional displacement between the first and second throttle bodies by an error in fabrication or by an error in assembly, then since the positional displacement is absorbed by elastic deformation of the communication means for communicating the first and second distribution pipes with each other, no excessive stress occurs with the distribution pipes, either. As a result, the fabrication error or the assembly error of the components is permitted by a large margin, which can contribute to improvement in productivity and quality and reduction in cost.

In another characteristic of the present invention, since the communication means is formed from the communication pipe fitted at both free end portions thereof in the first and second distribution pipes and the seal members interposed in the fitting portions and the positional displacement between the first and second distribution pipes is absorbed by elastic deformation of the seal members, the elastic seal members play a role of a positional displacement absorbing member, which can contribute to simplification and compaction of the structure of the fuel distribution pipe.

Also, in another characteristic of the present invention, positional displacement between the first and second throttle bodies is absorbed by variation of the fitting depths of the first and second fuel injection valves of the inverted V-shaped arrangement and the connection caps of the first and second distribution pipes. Accordingly, there is no necessity to provide special positional displacement absorption means, and besides, since only it is sufficient to fasten the fuel distribution pipe to only one of the first and second throttle bodies and the first and second distribution pipes are integrated with each other, simplification in structure, reduction in number of parts and number of assembly steps and compaction of the fuel distribution pipe can be anticipated.

BRIEF DESCRIPTION OF THE DRAWINGS

The advantages of the invention will become apparent in the following description taken in conjunction with the drawings, wherein.

DETAILED DESCRIPTION OF THE INVENTION

First, description is given beginning with the first working example of the present invention shown in FIGS. 1 to 5.

Figure 1:
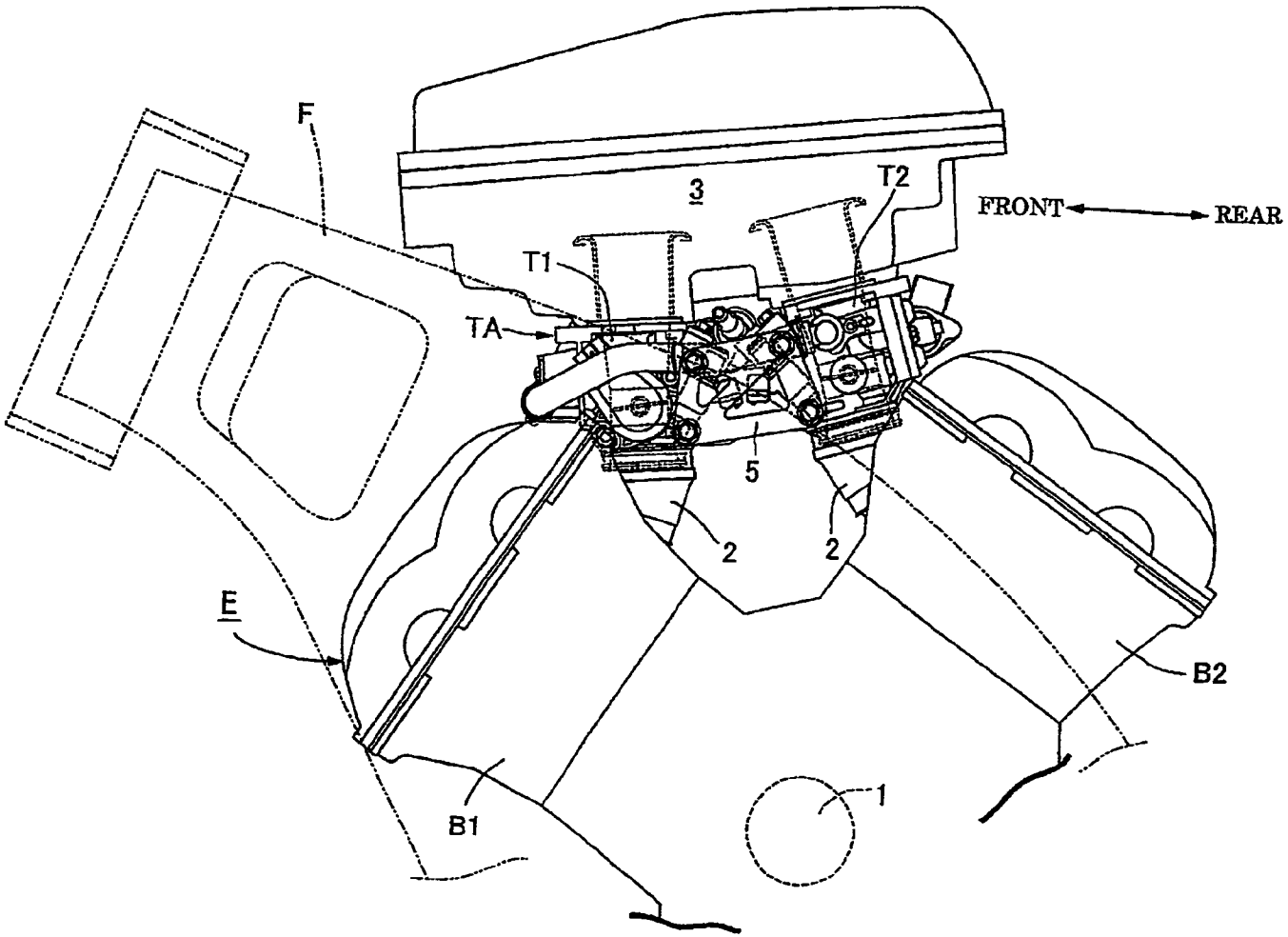
FIG. 1 is a side elevational view of part of a V-type engine for a motorcycle which includes a throttle body assembly according to a first working example of the present invention.

Referring to FIG. 1, in a V-type engine E carried on a vehicle body frame F of a motorcycle, a first bank B1 on the front side of a vehicle body and a second bank B2 on the rear side of the vehicle body are disposed in a V-shaped open state centered at a common crankshaft 1 disposed horizontally in a vehicle widthwise direction of the motorcycle.

Between the first and second banks B1 and B2, a throttle body assembly TA formed from first and second throttle bodies T1 and T2 mounted on elastic intake pipes 2, 2 of the first and second banks B1 and B2 and coupled to each other is disposed, and a common air cleaner 3 for filtering intake air of the first and second throttle bodies T1 and T2 is disposed above the throttle body assembly TA.

Figure 2:
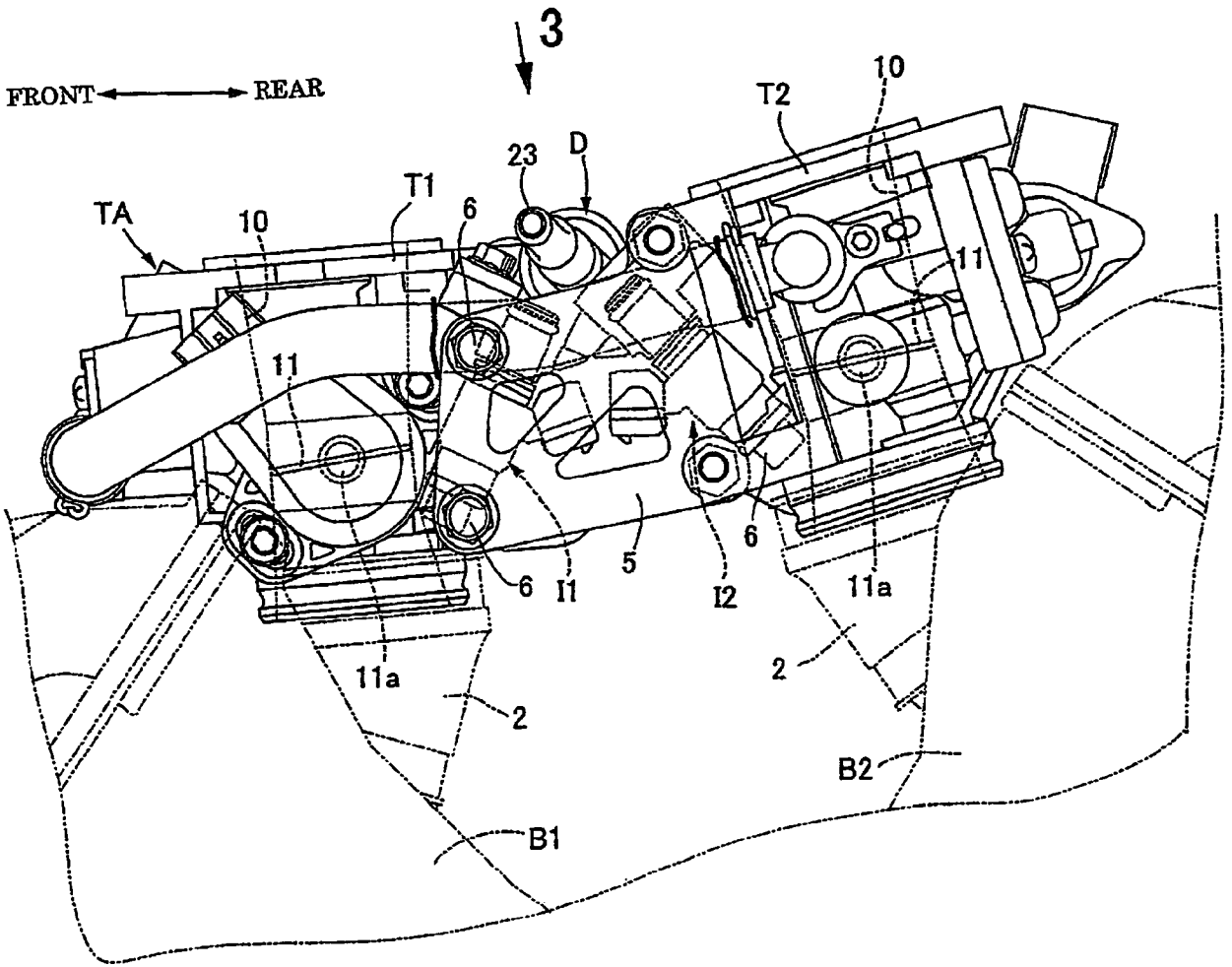
FIG. 2 is an enlarged view of the throttle body assembly in FIG. 1.
Figure 3:
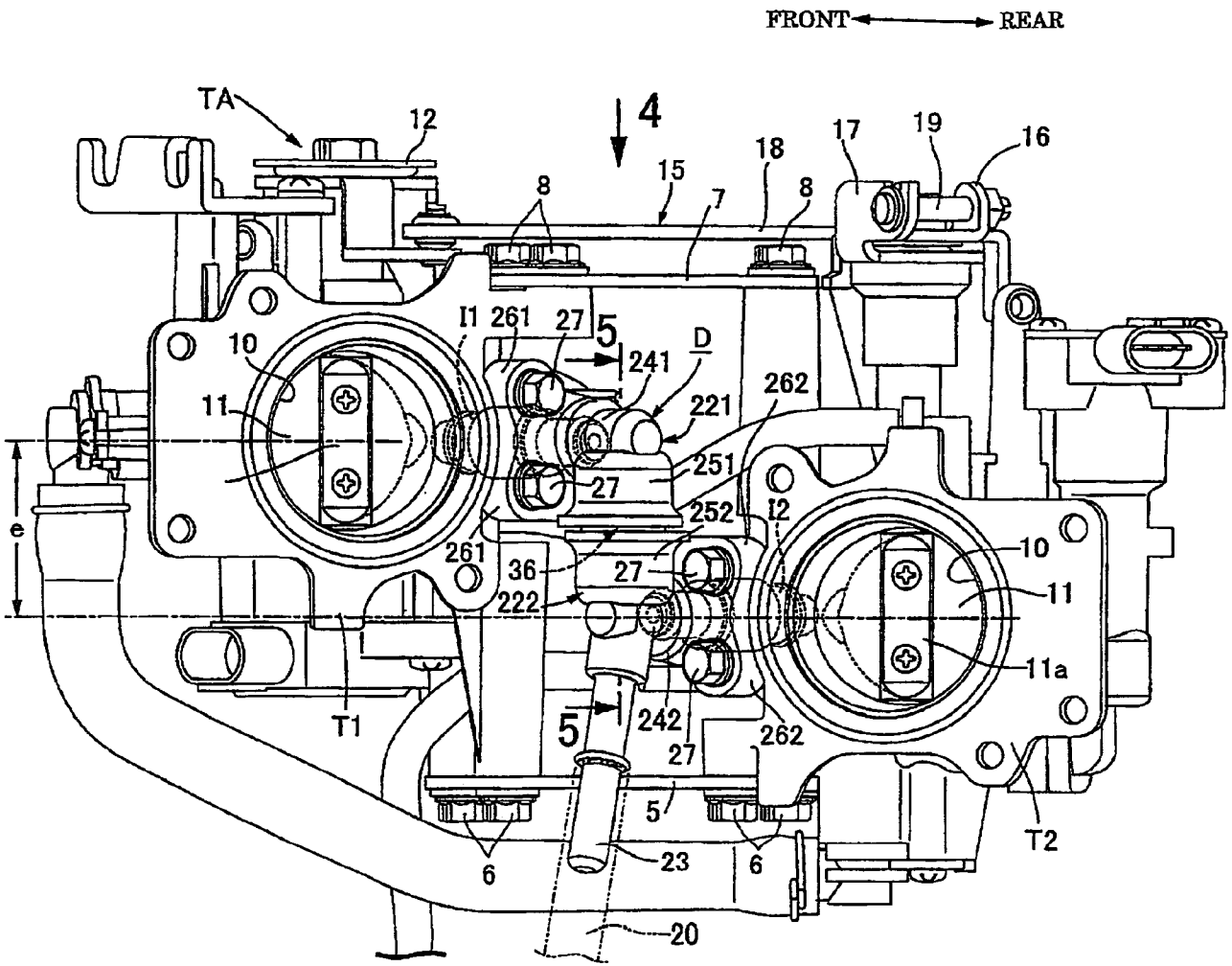
FIG. 3 is a view as viewed in the direction indicated by an arrow mark 3 in FIG. 2.
Figure 4:
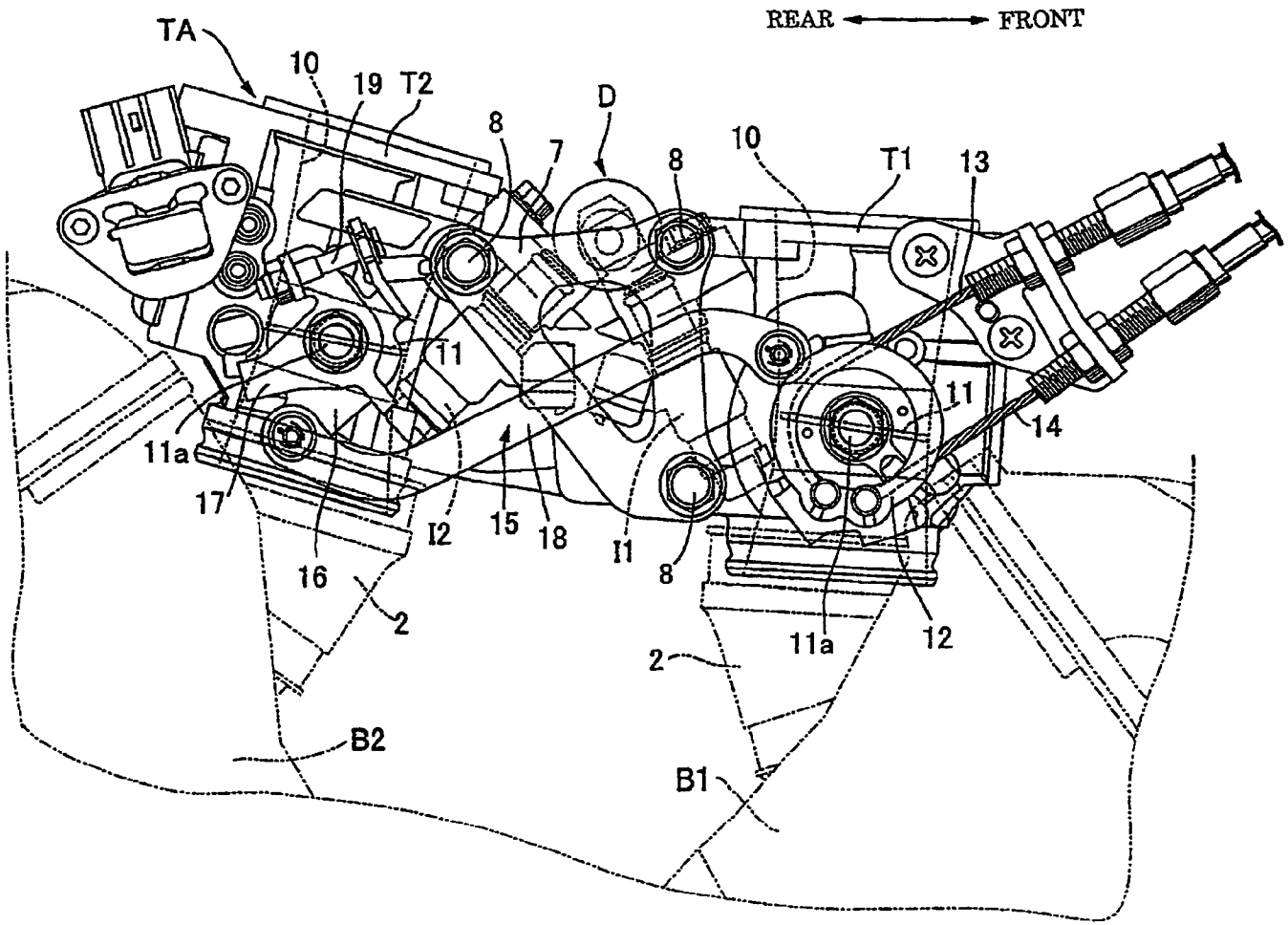
FIG. 4 is a view as viewed in the direction indicated by an arrow mark 4 in FIG. 3.
Figure 5:
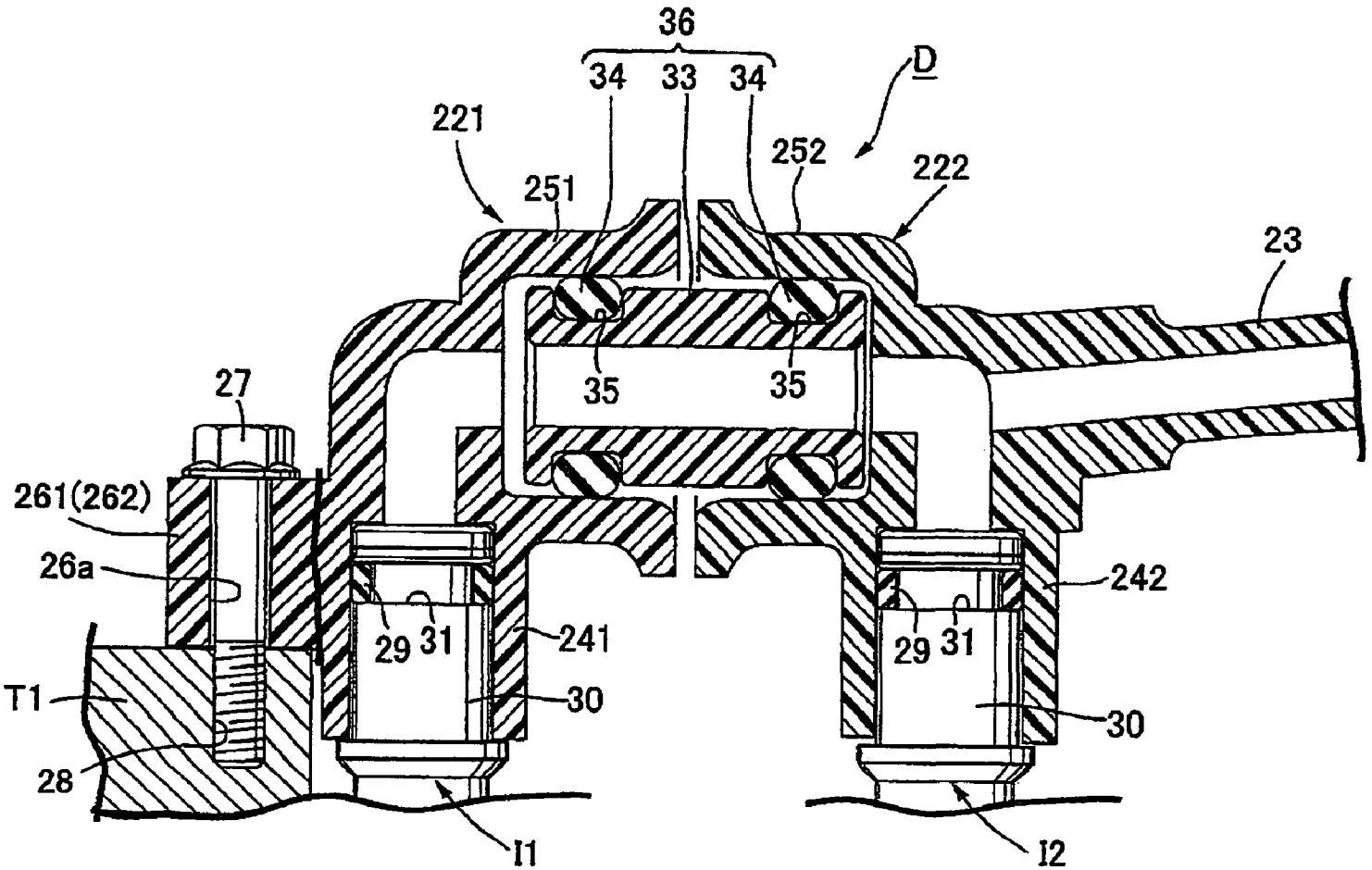
FIG. 5 is a sectional view taken along line 5-5 of FIG. 3.

As shown in FIGS. 2 to 4, a first connection plate 5 is connected to one side face of the first and second throttle bodies T1 and T2 by a plurality of bolts 6, and a second connection plate 7 is connected to the other side face of the first and second throttle bodies T1 and T2 by a plurality of bolts 8. The first and second throttle bodies T1 and T2 are coupled to each other by the two connection plates 5 and 7 to form the throttle body assembly TA in this manner.

Thereupon, as shown in FIG. 3, the first and second throttle bodies T1 and T2 are disposed in an offset state by a fixed distance e from each other in the direction of an axial line of the crankshaft 1 as viewed in plan. The offset distance e corresponds to the distance by which the first and second banks B1 and B2 are offset from each other in the axial direction of the crankshaft 1.

On the first and second throttle bodies T1 and T2, valve stems 11*a*, 11*a* of throttle valves 11, 11 for opening and closing intake paths 10, 10 are supported for pivotal motion in a posture substantially parallel to the crankshaft 1. To a throttle drum 12 secured to one of the valve stems 11*a*, 11*a* (in the example shown, the valve stem 11*a* on the first throttle body T1 side), an opening operation wire 13 and a closing operation wire 14 are connected, and by pulling the wires alternately by reciprocating pivotal motion of an acceleration grip of the motorcycle, the throttle drum 12 can be rotated in the opening and closing directions of the throttle valve 11.

This rotation of the throttle drum 12 is transmitted to the other valve stem 11*a* through an interlocking mechanism 15. This interlocking mechanism is formed from a first throttle lever 16 supported for pivotal motion on the other valve stem 11*a* (in the example shown, the valve stem 11*a* on the second throttle body T2) side, a second throttle lever 17 secured in the valve stem 11*a* in a neighboring relationship with the first throttle lever 16, a link 18 for connecting the throttle drum 12 and the first throttle lever 16 to each other, and a synchronization screw 19 capable of connecting the first and second throttle levers 16 and 17 to each other and adjusting the phases of the first and second throttle levers 16 and 17 therebetween. Thus, by phase adjustment between the first and second throttle levers 16 and 17, synchronism between the throttle valves 11, 11 of the first and second throttle bodies T1 and T2 can be achieved.

On the first and second throttle bodies T1 and T2, first and second fuel injection valves I1 and I2 of the electromagnetic type are mounted on the sides opposing to each other, and the first and second fuel injection valves I1 and I2 inject fuel to the downstream side of the individually corresponding intake paths 10, 10. To the first and second fuel injection valves I1 and I2, a main fuel distribution pipe D for distributing fuel from a common fuel supply system 20 is connected.

This main fuel distribution pipe D is composed of first and second distribution pipes 221 and 222 molded individually from a synthetic resin material and separate from each other. The first distribution pipe 221 is molded as a unitary member from a first connection cap 241 fitted liquid-tight on an outer periphery of a fuel entrance tubular portion 30 of the first fuel injection valve I1 through a seal member 29, a first connection tube 251 of bottomed cylindrical shape, and a pair of first fastening bosses 261. The insides of a joint pipe 23, the first connection cap 241 and the first connection tube 251 are communicated with each other.

Meanwhile, the second distribution pipe 222 is molded as a unitary member from a joint pipe 23 for allowing connection of the common fuel supply system 20, a second connection cap 242 fitted liquid-tight on an outer periphery of the fuel entrance tubular portion 30 of the second fuel injection valve I2 through a seal member 29 similarly, a second connection tube 252 of a bottomed cylindrical shape, and a pair of second connection bosses 262. The insides of the second connection cap 242 and the second connection tube 252 are communicated with each other. It is to be noted that also it is possible to form the joint pipe 23 on the first second distribution pipe 221 side.

The first and second fastening bosses 261 and 262 are fastened to the first and second throttle bodies T1 and T2, respectively, by screwing bolts 27, which individually extend through bolt holes 26*a*, into threaded holes 28 provided at predetermined positions of the first and second throttle bodies T1 and T2. Each of the seal members 29 is mounted on an outer circumferential groove 31 of the fuel entrance tubular portion 30 of each of the fuel injection valves I1 and I2.

The first and second connection tubes 251 and 252 are disposed on the same axis such that the openings thereof are positioned in an adjacent opposing relationship to each other, and both free end portions of a communication pipe 33 are loosely fitted in the first and second connection tubes 251 and 252. In annular grooves 35, 35 on an outer periphery of the opposite end portions of the communication pipe 33, elastic seal members 34, 34 (for example, O rings) which contact closely with the inner circumferential face of the corresponding first and second connection tubes 251 and 252 are mounted. Thus, the communication pipe 33 and the elastic seal members 34, 34 form communication conduit 36 which can communicate the first and second distribution pipes 221 and 222 with each other and absorb positional displacement between the first and second distribution pipes 221 and 222.

Now, operation of the present first working example is described.

During operation of the V-type engine E, fuel supplied from the common fuel supply system 20 to the first second distribution pipe 221 is supplied also to the second distribution pipe 222 through the communication pipe 33. The fuel distributed to the first and second distribution pipes 221 and 222 in this manner advances to the first and second connection tubes 251 and 252 side and goes to the first and second fuel injection valves I1 and I2 and is then injected to the downstream side of the intake paths 10, 10 of the first and second throttle bodies T1 and T2. In the intake paths 10, 10, the intake air amount is controlled by the throttle valves 11, 11 which are opened and closed in synchronism with each other, and the intake air is taken into the first and second banks B1 and B2 together with the injected fuel.

In order to assemble the throttle body assembly TA which includes the first and second throttle bodies T1 and T2, the fuel injection valves I1 and I2 are first mounted on the first and second throttle bodies T1 and T2, respectively, and then the first and second connection tubes 251 and 252 of the first and second distribution pipes 221 and 222 are fitted on the outer periphery of the fuel entrance tubular portions 30, 30 of the first and second fuel injection valves I1 and I2. Further, the first and second fastening bosses 261 and 262 are fastened to fixed positions of the first and second throttle bodies T1 and T2 by means of the bolts 27. Then, the opposite end portions of the communication pipe 33 on which the elastic seal members 34, 34 are provided are fitted into the first and second connection tubes 251 and 252 which are opposed to each other. Thereafter, the first and second throttle bodies T1 and T2 are connected to each other by the first and second connection plates 5 and 7 to configure the throttle body assembly TA.

At this time, if some positional displacement occurs also between the first and second distribution pipes 221 and 222 by positional displacement between the first and second throttle bodies T1 and T2 by an error in fabrication or an error in assembly, then since the positional displacement is absorbed by elastic deformation of the elastic seal members 34, 34, no trouble occurs with the communication between the two distribution pipes 221 and 222 by the communication pipe 33 and no excessive stress occurs with the distribution pipes 221 and 222.

After the assembly of the throttle body assembly TA, since motion of the communication pipe 33 in the axial direction is restricted by end walls of the first and second connection tubes 251 and 252, there is no necessity to specially provide axial restriction means for the communication pipe 33. Accordingly, not only contribution to simplification of the structure is achieved, but also free fine movement in all directions of the communication pipe 33 is permitted, and positional displacement between the first and second throttle bodies T1 and T2 can be absorbed smoothly.

After assembly of the throttle body assembly TA, the interlocking mechanism 15 is assembled to the first and second throttle bodies T1 and T2, and the synchronization screw 19 is adjusted to establish synchronization of the throttle valves 11, 11 of the first and second throttle bodies T1 and T2. Thereupon, positional displacement between the first and second throttle bodies T1 and T2 is absorbed by mutual movement of the components of the interlocking mechanism 15.

Thereafter, the downstream side end portions of the first and second throttle bodies T1 and T2 of the throttle body assembly TA are mounted on the elastic intake pipes 2, 2 of the first and second banks B1 and B2 to mount the throttle body assembly TA on the V-type engine E.

Since positional displacement between the first and second throttle bodies T1 and T2 can be absorbed by the fuel distribution pipe D and the interlocking mechanism 15 in such a manner as described hereinabove, an error in fabrication and an error in assembly of the components are permitted by a greater amount, which can contribute to improvement in productivity and quality and reduction in cost.

Particularly, in the fuel distribution pipe D, since the communication means 36 is formed from the communication pipe 33 fitted at both free end portions thereof in the first and second connection tubes 251 and 252 and the elastic seal members 34, 34 interposed between the fitting portions and positional displacement between the first and second distribution pipes 221 and 222 is absorbed by elastic deformation of the elastic seal members 34, 34, the elastic seal members 34, 34 play a role of a positional displacement absorbing member, which can contribute to simplification and compaction of the structure of the fuel distribution pipe D.

Figure 6:
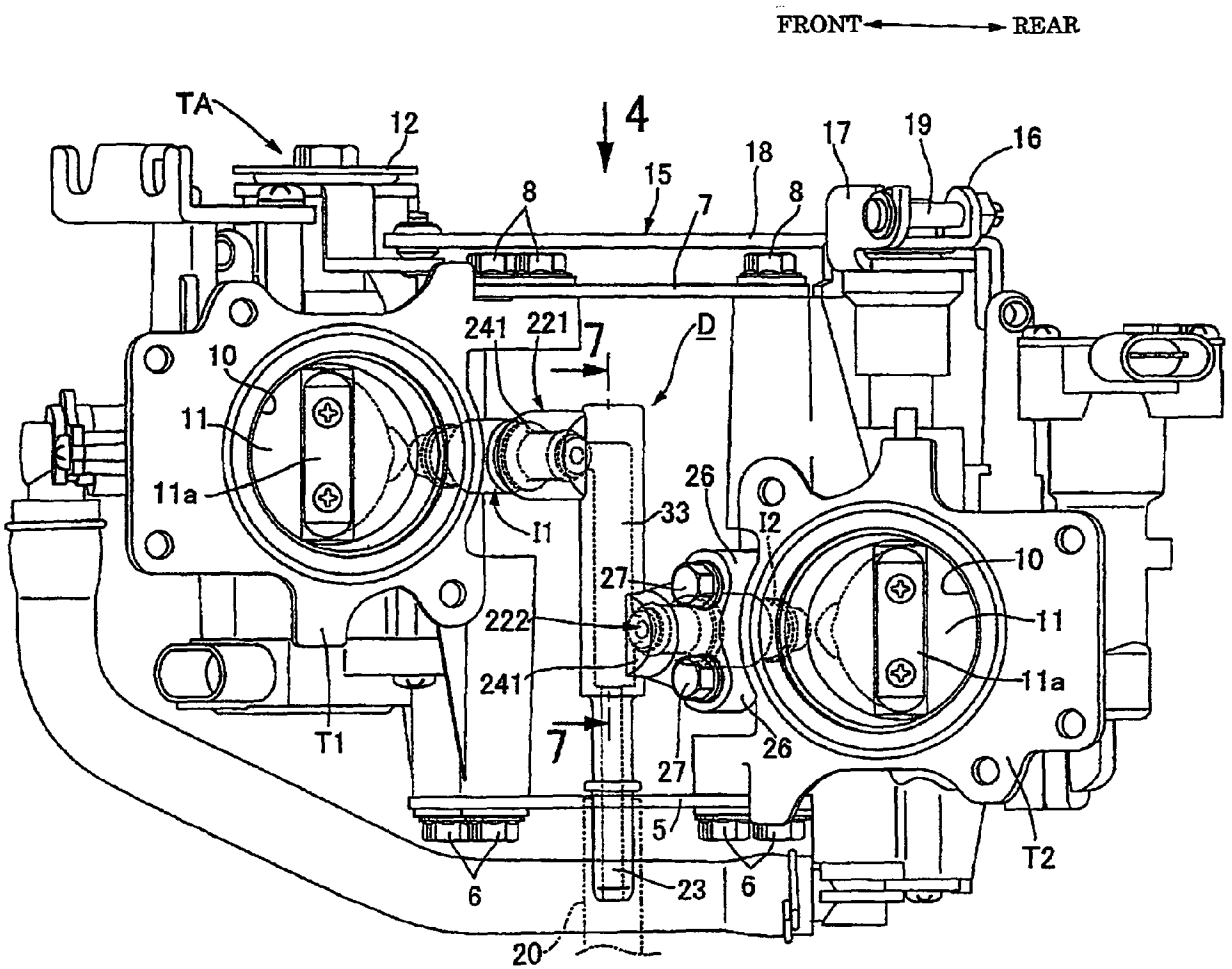
FIG. 6 is a view corresponding to FIG. 3 but showing a second working example of the present invention.
Figure 7:
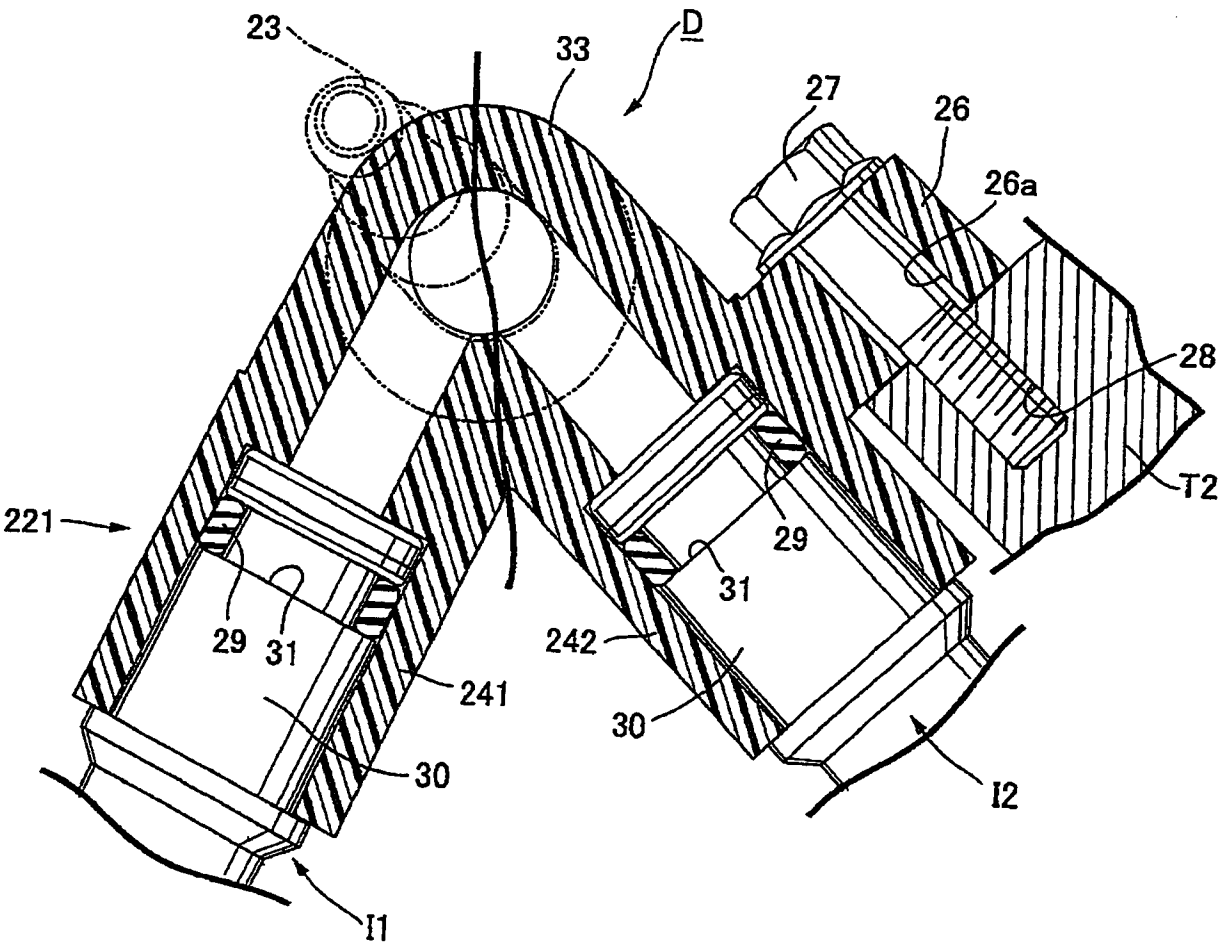
FIG. 7 is a sectional view taken along line 7-7 of FIG. 6.

Now, a second working example of the present invention shown in FIGS. 6 and 7 is described.

In the second embodiment, it is first necessary for the first and second fuel injection valves I1 and I2 mounted on the first and second throttle bodies T1 and T2 to be disposed so as to exhibit an inverted V shape as viewed in side elevation from an axial direction of the crankshaft 1 (refer to FIG. 1) of the V-type engine E. Then, the fuel distribution pipe D is formed by integral molding of a synthetic resin material from the first and second connection caps 241 and 242 disposed in an inverted V shape as viewed in side elevation so as to be fitted in the fuel entrance tubular portions 30, 30 of the first and second fuel injection valves I1 and I2, respectively, the communication pipe 33 for communicating the first and second connection caps 241 and 242 with each other, the joint pipe 23 for connecting the fuel supply system 20, and a fastening boss 26 for being fastened only to one of the first and second throttle bodies T1 and T2 (in the example shown, the second throttle body T2). The fastening structure of the fastening boss 26 to the first throttle body T1 or the second throttle body T2 by the bolts 27 is similar to that in the preceding working example. Since the configuration of the other part is similar to that in the preceding embodiment, corresponding portions to those in the preceding working example are denoted by like reference characters and overlapping description thereof is omitted.

According to this second working example, positional displacement between the first and second throttle bodies T1 and T2 is absorbed by variation of the fitting depths of the first and second fuel injection valves I1 and I2 of the inverted V-shaped arrangement and the first and second connection caps 241 and 242 of the first and second distribution pipes 221 and 222 and elastic deformation of the seal members 29 provided at the fitting portions. Accordingly, there is no necessity to provide special positional displacement absorption means, and besides, since only it is sufficient to fasten the fuel distribution pipe D to only one of the first and second throttle bodies T1 and T2 and the first and second distribution pipes 221 and 222 are integrated with each other, simplification in structure, reduction in number of parts and number of assembly steps and compaction of the fuel distribution pipe D can be anticipated.

While the embodiment of the present invention is described above, the present invention is not limited to the embodiment described above but allows various design changes without departing from the subject matter of the present invention.

We claim:

1. A fuel distribution apparatus for a v-type engine, having first and second throttle bodies, respectively connected to first and second cylinder banks of the engine and disposed therebetween, said fuel distribution apparatus comprising:

a main fuel distribution pipe for distributing fuel from a common fuel supply system, to first and second fuel injection valves provided in the first and second throttle bodies, respectively, wherein said main fuel distribution pipe includes, a) a first distribution pipe integrally including, i) a first connection portion communicating with the first fuel injection valve, and ii) a first fastening boss fastenable to a fixed portion of the first throttle body, b) a second distribution pipe, separate from said first distribution pipe, and integrally including, i) a second connection portion communicating with the second fuel injection valve, and ii) a second fastening boss fastenable to a fixed portion of the second throttle body, c) a joint pipe formed with one of said first and second distribution pipes for communicating with the fuel supply system, and d) a communication conduit, communicating between said first and second distribution pipes and absorbing positional displacement therebetween.

2. The fuel distribution apparatus according to claim 1, wherein said communication conduit further comprising:

a communication pipe fitted, at both free end portions thereof, in said first and second distribution pipes; and seal members fitted, between said communication pipe and said first and second distribution pipes, such that a positional displacement between said first and second distribution pipes is absorbed by elastic deformation of said seal members.

3. A fuel distribution apparatus for a v-type engine, having first and second throttle bodies, respectively connected to first and second cylinder banks of the engine and disposed therebetween, said fuel distribution apparatus comprising:

a main fuel distribution pipe for distributing fuel from a common fuel supply system, to first and second fuel injection valves provided in the first and second throttle bodies, respectively, wherein said main fuel distribution pipe includes, a) first and second connection caps fitted in fuel entrance tube portions of the first and second fuel injection valves, respectively, wherein said first and second fuel injection valves are disposed in such a manner as to exhibit an inverted v-shape as viewed in a side elevation, b) a communication pipe communicating said first and second connection caps with one another, c) a joint pipe communicating said first and second connection caps with the fuel supply system, and d) a fastening boss fastenable to a fixed portion of only one of the first and second throttle bodies, wherein said connection caps, said communication pipe, said joint pipe and said fastening boss are integrally formed into said main fuel distribution pipe.

* * * * *